US005551208A

United States Patent [19]

Van Erden

[11] Patent Number: 5,551,208

[45] Date of Patent: Sep. 3, 1996

[54] METHOD FOR APPLYING ZIPPER TO FILM AT TUBE ON A FORM-FILL-AND-SEAL

[75] Inventor: Donald Van Erden, Wildwood, Ill.

[73] Assignee: Minigrip, Inc., Orangeburg, N.Y.

[21] Appl. No.: 454,741

[22] Filed: May 31, 1995

[51] Int. Cl.[6] ..... B65B 51/04

[52] U.S. Cl. ..... 53/139.2; 53/451; 53/133.4

[58] Field of Search ..... 493/213; 53/451, 53/551, 139.2, 133.4

[56] References Cited

U.S. PATENT DOCUMENTS

| | | | |
|---|---|---|---|
| 4,993,212 | 2/1991 | Veoukas | 53/551 |
| 5,014,498 | 5/1991 | McMahon | 493/213 |
| 5,046,300 | 9/1991 | Custer et al. | 53/551 |
| 5,127,208 | 7/1992 | Custer et al. | 53/551 |
| 5,425,216 | 6/1995 | Ausnit | 53/551 |

*Primary Examiner*—Lowell A. Larson

*Assistant Examiner*—Gene L. Kim

*Attorney, Agent, or Firm*—Kane, Dalsimer, Sullivan, Kurucz, Levy, Eisele and Richard, LLP

[57] ABSTRACT

A method for manufacturing reclosable packages on a form, fill and seal machine includes the step of providing a continuous sheet of thermoplastic material with a Z-fold extending longitudinally therealong before the sheet is wrapped around a filling tube for forming and filling the packages. The Z-fold is maintained on the tube of thermoplastic material thus formed until it reaches a loop opener on the outside surface of the filling tube. The loop opener transforms the Z-fold into a loop extending longitudinally along and outwardly from the filling tube and from the tube of thermoplastic material wrapped therearound. Simultaneously, a continuous plastic zipper having a pair of mutually interlocking profiles is directed into the tube of thermoplastic material along a channel on the outside surface of the filling tube. The zipper is ultimately guided out from the channel, through the loop opener and into the loop, and is sealed thereto to form the reclosable openings for the plastic packages being manufactured.

7 Claims, 3 Drawing Sheets

METHOD FOR APPLYING ZIPPER TO FILM AT TUBE ON A FORM-FILL-AND-SEAL

BACKGROUND OF THE INVENTION

1. Field of the Invention

The present invention relates to the manufacture of plastic bags or packages on a form, fill and seal (FFS) machine, particularly a vertical form, fill and seal (VFFS) machine, from a sheet of thermoplastic material, wherein each plastic bag or package includes a reclosable plastic zipper comprising a pair of mutually interlocking zipper profiles. Specifically, the present invention comprises a method for continuously and sequentially forming bags or packages having such zippers disposed in a direction parallel to that of the filling tube of the FFS machine, and, consequently, in the direction in which the thermoplastic sheet progresses on the FFS machines during the production of the bags or packages. More specifically, the method concerns the attachment of a reclosable plastic zipper to the inside of a loop in a tube formed from the sheet of thermoplastic material during the production and filling of the bags or packages on a form, fill and seal machine.

2. Description of the Prior Art

The present invention relates to improvements in the package-making art and may be practiced in the manufacture of thermoplastic bags and packages of the kind that may be used for various consumer products, but which are particularly useful for food products which must be kept in moisture- and air-tight packages, free from leakage until initially opened for access to the product contents, which packages are then reclosable by zipper means to protect any remainder of the product therein.

The indicated art is fairly well-developed, but nevertheless remains susceptible to improvement contributing to increased efficiency and cost-effectiveness.

One problem that hampers the production of packages from continuous zipper-equipped sheet material is the difficulty in forming a longitudinal loop in a tube made from a sheet of thermoplastic material on a form, fill and seal machine, and in attaching a continuous reclosable plastic zipper to the inside surface thereof during the production of plastic bags or packages, the loop having the reclosable plastic zipper ultimately becoming the mouth of the bag or package. The difficulty, exacerbated by the high speeds at which form, fill and seal machines are operated, lies in the creasing and tearing of the thermoplastic sheet material during the formation of the loop.

U.S. Pat. No. 5,046,300 discloses an attempt at a solution to this problem, wherein packaging film is formed into a tubular form about a forming tube. Subsequently, the tubular shaped packaging film is advanced along the length of the forming tube and over a product fill tube having a circumference less than that of the forming tube. The packaging film is deformed to conform to the circumference of the product fill tube. Excess packaging film, made available due to the difference between the circumferences of the forming tube and product fill tube, is formed into a loop. A reclosable profile element is guided into the loop and adhered to the inner surface of the loop. The deformation required to conform the packaging film to the circumference the product fill tube has proved to be difficult to achieve in a controlled fashion in practice, and has been the source of many operating problems caused by the creasing and tearing of the sheet at high machine speeds.

The present invention represents an advance over that disclosed in U.S. Pat. No. 5,046,300 in that the loop, in which the reclosable plastic zipper is ultimately to be disposed, is formed in the sheet of thermoplastic material before it is wrapped around the fill tube of a form, fill and seal machine.

SUMMARY OF THE INVENTION

Accordingly, the present invention is a method for manufacturing reclosable packages on a form, fill and seal machine wherein a continuous sheet of thermoplastic material having first and second lateral edges is provided with a Z-fold extending longitudinally therealong between said first and second lateral edges before said continuous sheet, guided by a forming collar, is wrapped around the filling tube of a form, fill and seal machine.

The continuous sheet having Z-fold forms a tube wrapped around the filling tube, and, as is customary, the first and second lateral edges thereof are brought together to form a fin extending longitudinally along the filling tube and outwardly therefrom. The fin is sealed to provide a fin seal extending longitudinally along the tube.

A continuous reclosable plastic zipper comprising a pair of mutually interlocking zipper profiles is simultaneously fed into the .tube of thermoplastic material along a channel extending longitudinally along the filling tube. A loop opener, extending longitudinally along and outwardly from the filling tube, forces the Z-fold into a loop also extending longitudinally along and outwardly from the filling tube. The continuous reclosable plastic zipper is directed from the channel through the loop opener and into the loop formed from the Z-fold. Each one of the pair of mutually interlocking zipper profiles of the reclosable plastic zipper is then sealed to opposed inside surfaces of the loop.

The tube is then sealed transversely at intervals therealong to complete the manufacture of individual reclosable packages from the sheet of thermoplastic material.

The present invention will now be described in more complete detail with frequent references being made to the several drawing figures identified below.

DETAILED DESCRIPTION OF THE PREFERRED EMBODIMENT

Figure 1:
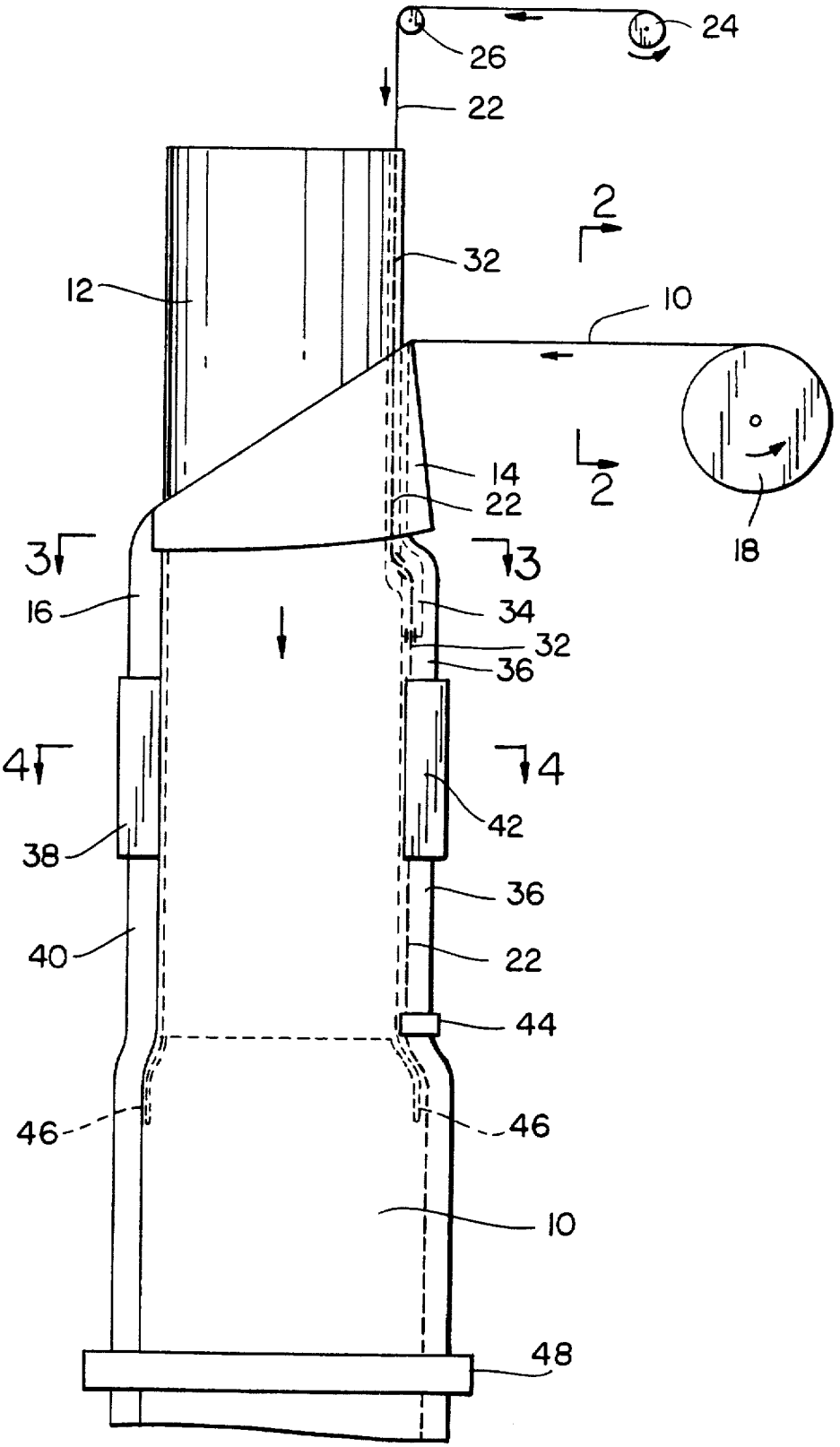
FIG. 1 is a side perspective view of a form, fill and seal machine adapted to manufacture reclosable plastic packages in accordance with the present invention.

Referring now to FIG. 1, plastic sheet material 10 is directed toward a filling tube 12 and associated forming collar 14, which guides the plastic sheet material 10 around the filling tube 12 to form a tube from the plastic sheet material 10. The filling tube 12 may, for example, be that of a conventional vertical form, fill and seal (VFFS) machine, which is so-called because the filling tube 12 is oriented in a substantially vertical direction, permitting the material intended to be the contents of the plastic bags or packages being produced to simply fall in preselected amounts there-into. The lateral edges of the plastic sheet material 10 are brought together to form fin 16, which forms the longitudinal side of the plastic bags or packages being manufactured in accordance with the present invention, where the word "longitudinal" implies that the fin 16 is aligned with the filling tube 12.

With the present invention, the filling tube 12 may have a constant circumference along its length.

Figure 2:
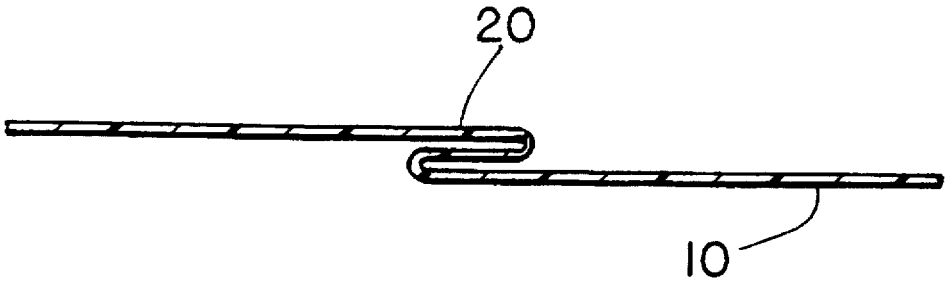
FIG. 2 is a cross-sectional view taken as indicated by line 2—2 in FIG. 1.

Plastic sheet material 10 is dispensed from a pay-off roll 18. Between the pay-off roll 18 and the filling tube 12 and associated forming collar 14, a Z-fold 20 extending longitudinally therealong between the lateral edges of the plastic sheet material 10 is formed. FIG. 2 is a cross-sectional view of the plastic sheet material 10 taken as indicated by line 2—2 in FIG. 1 and showing Z-fold 20.

Figure 3:
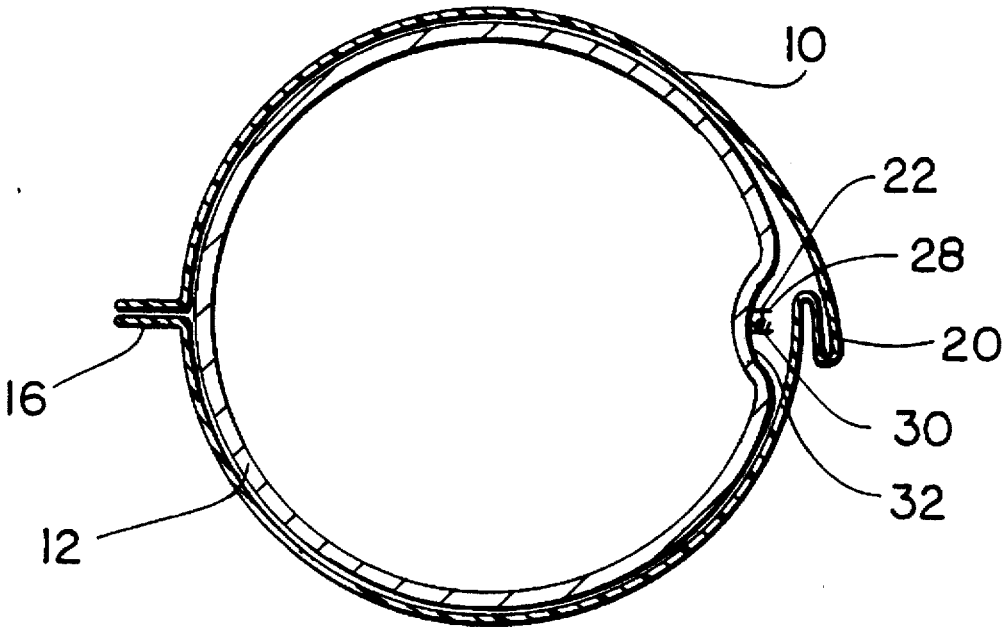
FIG. 3 is a cross-sectional view taken as indicated by line 3—3 in FIG. 1.

A continuous reclosable plastic zipper 22 comprising a pair of mutually interlocking zipper profiles is fed from a supply roll 24 and around one or more guide rolls 26, and directed within the tube formed from plastic sheet material 10 around the filling tube 12. Referring to FIG. 3, which is a cross-sectional view taken as indicated by line 3—3 in FIG. 1, continuous reclosable plastic zipper 22 comprises a pair of mutually interlocking profiles 28, 30, which may be a male and a female profile. Zipper 22 is disposed in and is guided within a channel 32 in the outside surface of the filling tube 12, and is adjacent to Z-fold 20.

Continuous reclosable plastic zipper 22 proceeds within channel 32 until it reaches loop opener 34, which opens Z-fold 20 into a loop 36 extending longitudinally along and outward from the filling tube 12. Zipper 22 passes from channel 32, through loop opener 34 and into loop 36.

Figure 4:
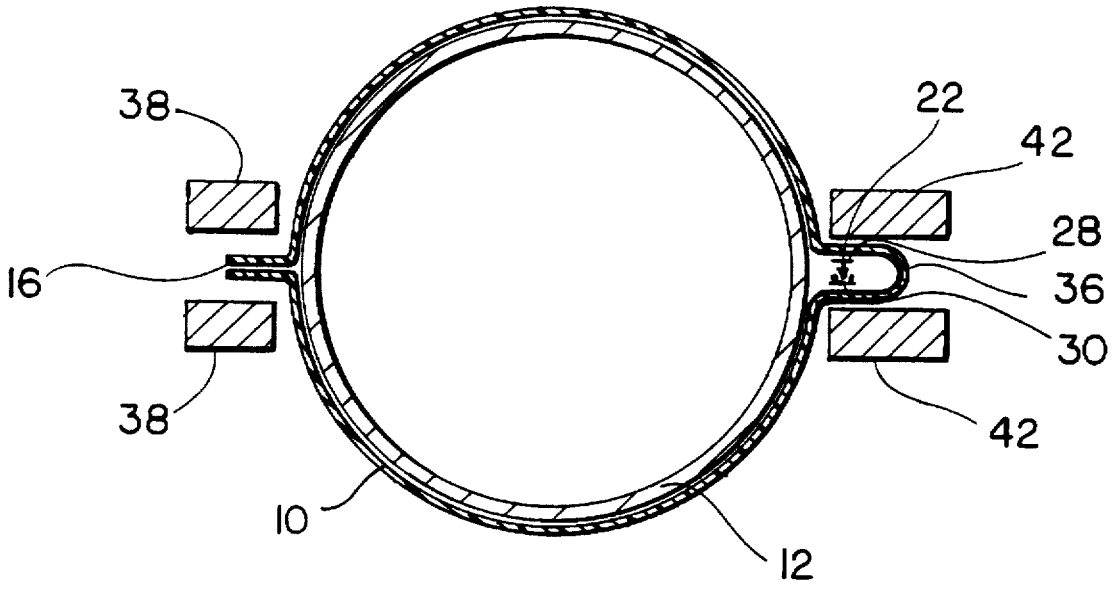
FIG. 4 is a cross-sectional view taken as indicated by line 4—4 in FIG. 1.

Referring to FIG. 4, a cross-sectional view taken as indicated by line 4—4 in FIG. 1, fin 16 is sealed by fin seal bars 38 to form a fin seal 40. Zipper seal bars 42 seal each one of the pair of mutually interlocking profiles 28, 30 of zipper 22 to opposed surfaces of the inside of the loop 36.

Referring back to FIG. 1, there may optionally be a spot-sealer 44 for sealing the loop 36 and zipper 22 permanently together at intervals corresponding to the locations where transverse seals will later be made across the tube of plastic sheet material 10. Spot-sealer 44 serves to flatten the zipper 22 at those locations to reduce the occurrence of leaking packages which may result when the transverse seal does not completely flatten it.

Attached to the bottom of the filling tube 12 are spreaders 46, which spread the tube of plastic sheet material 10 into a more flattened package- or pouch-like configuration.

It should be understood that the manufacture of reclosable packages in accordance with the present invention proceeds sequentially. Below the filling tube 12 are transverse seal bars 48, which both seal the bottom of the tube of plastic sheet material 10, as well as seal the top of the previously made package at the same time as severing it from the bottom of the tube. A premeasured amount of some consumer product then is released through the filling tube 12 into the tube of plastic sheet material 10. Finally, the tube of plastic sheet material 10 advances an amount equal to the width of one package, and the transverse seal bars 48 are activated to seal the top of the package.

It should also be understood that the Z-fold 20 need not necessarily be placed at the middle of the plastic sheet 10 (resulting in the zipper being positioned opposite the fin seal as shown in FIG. 4). For example the Z-fold could be positioned at one quarter the width of the plastic sheet to thereby provide a so-called "J-fold" package where the zipper is at an edge of the package and the seam is across the package back.

Modifications to the above would be obvious to those of ordinary skill in the art, but would not bring the invention so modified beyond the scope of the appended claims.

What is claimed is:

1. A method for manufacturing reclosable packages on a form, fill and seal machine comprising the steps of:

a) providing a continuous sheet of thermoplastic material having a first and a second lateral edge;

b) forming a Z-fold longitudinally along said continuous sheet between said first and second lateral edges;

c) directing said Z-folded continuous sheet onto the forming collar of a form, fill and seal machine and about a filling tube thereof, thereby bringing said first and second lateral edges of said continuous sheet together to form a fin extending longitudinally along and outwardly from said filling tube and to form a tube from said continuous sheet;

d) providing a continuous reclosable plastic zipper comprising a pair of mutually interlocking zipper profiles;

e) feeding said continuous reclosable plastic zipper into said tube of said thermoplastic material;

f) sealing said fin formed by said first and second lateral edges of said continuous sheet together to form a fin seal;

g) directing said Z-fold outwardly from said filling tube and opening said Z-fold to provide a loop extending longitudinally along said filling tube;

h) guiding said continuous reclosable plastic zipper into said loop;

i) sealing each one of said pair of mutually interlocking zipper profiles of said reclosable plastic zipper to opposed inside surfaces of said loop; and j) sealing said tube transversely at intervals therealong to form individual reclosable packages from said sheet of thermoplastic material.

2. A method as claimed in claim 1 further comprising the step of spot-sealing said loop and said reclosable plastic zipper at intervals therealong prior to the step of sealing said tube transversely at the same intervals therealong.

3. A method as claimed in claim 1 wherein said step of unfolding said Z-fold comprises passing said Z-fold over a loop opener extending longitudinally along and outwardly from said filling tube.

4. A method as claimed in claim 1 wherein said step of feeding said continuous reclosable plastic zipper into said tube comprises feeding said zipper into a channel extending longitudinally along the outside surface of said filling tube.

5. A method as claimed in claim 3 wherein said step of feeding said continuous reclosable plastic zipper into said tube comprises feeding said zipper into a channel extending longitudinally along the outside surface of said filling tube, said channel extending to said loop opener, and wherein said step of guiding said continuous reclosable plastic zipper into said loop comprises directing said zipper from said channel through said loop opener and into said just-opened loop.

6. A method as claimed in claim 1 wherein said Z-fold is formed at substantially the midpoint between said lateral edges.

7. A method as claimed in claim 1 wherein said Z-fold is formed at substantially one quarter the distance between said lateral edges.

* * * * *

UNITED STATES PATENT AND TRADEMARK OFFICE

CERTIFICATE OF CORRECTION

PATENT NO. : 5,551,208

DATED : September 3, 1996

INVENTOR(S) : Donald Van Erden

It is certified that error appears in the above-indentified patent and that said Letters Patent is hereby corrected as shown below:

On the title page, Item [54], and column 1, line 2, correct tthe title to read as follows:

METHOD FOR APPLYING ZIPPER TO FILM AT TUBE ON A FORM-FILL-AND-SEAL MACHINE

Signed and Sealed this

Tenth Day of December, 1996

*Attest:*

*Attesting Officer*

BRUCE LEHMAN

*Commissioner of Patents and Trademarks*